US007861321B2

(12) United States Patent
Winningham

(10) Patent No.: US 7,861,321 B2
(45) Date of Patent: Jan. 4, 2011

(54) SPORTS GLOVE HAVING PROTECTIVE KNUCKLE SEGMENT

(75) Inventor: Matthew M. Winningham, Royal Oak, MI (US)

(73) Assignee: Warrior Sports, Inc., Warren, MI (US)

( * ) Notice: Subject to any disclaimer, the term of this patent is extended or adjusted under 35 U.S.C. 154(b) by 497 days.

(21) Appl. No.: 12/051,201

(22) Filed: Mar. 19, 2008

(65) Prior Publication Data

US 2008/0244797 A1 Oct. 9, 2008

Related U.S. Application Data

(60) Provisional application No. 60/895,502, filed on Mar. 19, 2007.

(51) Int. Cl.
*A41D 19/00* (2006.01)

(52) U.S. Cl. ..... 2/161.1; 2/163

(58) Field of Classification Search ..... 2/16, 2/20, 21, 161.1, 161.6, 163
See application file for complete search history.

(56) References Cited

U.S. PATENT DOCUMENTS

| | | | |
|---|---|---|---|
| 3,037,209 | A | 6/1962 | Applegate, Jr. et al. |
| 3,882,548 | A | 5/1975 | Shinagawa et al. |
| 4,094,014 | A | 6/1978 | Schroeder |
| 4,355,424 | A | 10/1982 | McCoy, Jr. |
| 4,411,024 | A | 10/1983 | Hayes |
| 4,497,073 | A | 2/1985 | Deutsch |
| 4,519,097 | A | 5/1985 | Chappell, Jr. et al. |
| 4,570,269 | A | 2/1986 | Berlese |
| 4,662,006 | A | 5/1987 | Ross, Jr. |
| 4,815,147 | A | 3/1989 | Gazzano et al. |
| 4,894,866 | A | 1/1990 | Walker |
| 4,894,868 | A | 1/1990 | Christopher |
| 4,930,162 | A | 6/1990 | Cote |
| 4,947,486 | A | 8/1990 | Hsuih |

(Continued)

FOREIGN PATENT DOCUMENTS

| | | |
|---|---|---|
| WO | WO03/013292 | 2/2003 |

(Continued)

OTHER PUBLICATIONS

Debeer, The Response, "Response" Glove, 2004.

(Continued)

*Primary Examiner*—Katherine Moran
(74) *Attorney, Agent, or Firm*—Warner Norcross & Judd LLP

(57) ABSTRACT

A protective sports glove that includes a protective knuckle system introduced to the outside of the glove in the finger and thumb portions that includes a flexible base portion that is sewn or otherwise affixed to the underlying inner layer and located over a wearer's knuckles. The flexible base portion includes at least one protruding portion extending upwardly and outwardly from the flexible base section opposite the inner layer. Coupled within or to the ends of each of the respective protruding portion is a knuckle cap portion. The knuckle cap portions are located in the gaps between the padded portions of the finger and thus provide protection to the knuckle of the wearer where the fingers or thumb are flexed and align when the finger or thumb are not flexed.

22 Claims, 4 Drawing Sheets

U.S. PATENT DOCUMENTS

| | | | |
|---|---|---|---|
| 4,984,300 | A | 1/1991 | Cho |
| 5,329,639 | A | 7/1994 | Aoki |
| 5,345,609 | A | 9/1994 | Fabry et al. |
| 5,459,883 | A | 10/1995 | Garceau-Verbeck |
| 5,488,739 | A | 2/1996 | Cardinal |
| 5,511,243 | A | 4/1996 | Hall et al. |
| 5,548,844 | A | 8/1996 | Ceresia |
| 5,745,916 | A | 5/1998 | Linner |
| 5,787,506 | A | 8/1998 | Wilder et al. |
| 5,946,720 | A | 9/1999 | Sauriol |
| 5,974,588 | A | 11/1999 | Furman |
| 5,983,396 | A | 11/1999 | Morrow et al. |
| 6,085,354 | A | 7/2000 | Wilder et al. |
| 6,122,769 | A | 9/2000 | Wilder et al. |
| 6,154,882 | A | 12/2000 | Ullmann |
| 6,209,137 | B1 | 4/2001 | Wallick |
| 6,233,744 | B1 | 5/2001 | McDuff |
| D446,888 | S | 8/2001 | Morrow |
| 6,389,601 | B2 | 5/2002 | Kleinert |
| 6,405,380 | B1 | 6/2002 | Kuroda et al. |
| D462,146 | S | 8/2002 | Aoki |
| 6,453,474 | B2 | 9/2002 | Kleinert |
| 6,526,592 | B1 | 3/2003 | Best |
| 6,543,057 | B2 | 4/2003 | Beland et al. |
| 6,550,069 | B1 | 4/2003 | Morrow |
| 6,625,815 | B2 | 9/2003 | Litke |
| 6,681,402 | B1 | 1/2004 | Bevier et al. |
| 6,684,406 | B2 | 2/2004 | Fowler |
| 6,701,530 | B2 | 3/2004 | Kleinert |
| 6,813,780 | B2 | 11/2004 | Morrow |
| 6,959,453 | B2 | 11/2005 | Best |
| 7,000,256 | B2 | 2/2006 | Kleinert |
| 7,275,268 | B2 | 10/2007 | Gait |
| 7,370,373 | B2 | 5/2008 | Kohler |
| 2003/0014805 | A1 | 1/2003 | Morrow et al. |
| 2004/0010834 | A1 | 1/2004 | Sidlo |
| 2004/0060096 | A1 | 4/2004 | Thiruppathi |
| 2004/0093656 | A1 | 5/2004 | Morrow et al. |
| 2004/0123372 | A1 | 7/2004 | Kleinert |
| 2006/0107432 | A1 | 5/2006 | Cicero |
| 2007/0261149 | A1 | 11/2007 | Gait |
| 2008/0083048 | A1 | 4/2008 | Morrow et al. |
| 2008/0104737 | A1 | 5/2008 | Shepherd |
| 2008/0146981 | A1 | 6/2008 | Greenwald et al. |
| 2008/0244799 | A1 * | 10/2008 | Winningham ..... 2/16 |
| 2009/0222967 | A1 * | 9/2009 | Winningham et al. ..... 2/21 |

FOREIGN PATENT DOCUMENTS

| | | |
|---|---|---|
| WO | WO2007/103985 | 9/2007 |

OTHER PUBLICATIONS

Debeer, The Tropic, "Tropic" Glove, 2004.
Debeer, The Arctic, "Arctic" Glove, 2004.
Brine, "Winter" Glove, 2004.
Brine, "Performance" Glove, 2004.
Brine "Elite" Glove, 2004.
Brine "Element" Glove, 2004.
STX "Reflex" Glove, 2004.
STX "Winter" Glove, 2004.
STX "¾ Finger" Glove, 2004.

* cited by examiner

SPORTS GLOVE HAVING PROTECTIVE KNUCKLE SEGMENT

CROSS-REFERENCE TO RELATED APPLICATIONS

The present application claims priority from U.S. Provisional Patent Application Ser. No. 60/895,502, filed Mar. 19, 2007, and entitled "Sports Glove Having Protective Knuckle."

TECHNICAL FIELD

The present invention relates generally to a protective glove for use in contact sports, such as hockey or lacrosse. More particularly, the present invention relates to a protective sports glove having improved protection, particularly for a knuckle of a wearer.

BACKGROUND OF THE INVENTION

In contact sports, such as lacrosse or hockey, where sticks are essential elements of the game, a player's hands, including their fingers and thumb, and wrists are especially vulnerable to injury when being checked by another player's stick. For this reason, players typically utilize padded gloves to protect their hands, wrists and lower forearms during play.

Typical gloves for such contact sports generally include a hand portion coupled to a plurality of finger portions and a thumb portion. The hand portion, the finger portions, and the thumb portion each have a respective palm portion and a protective back with a plurality of protective portions, such as pads, disposed thereon to provide protection to a wearer's hand from forces applied thereto during play. The gloves also typically have a protective cuff or portion that is coupled to a lower edge of the hand portion and extends downwardly from the back portion to protect the wearer's wrist and forearm. The protective back portions of the hand portion, the plurality of finger portions and the thumb portion are formed in such a way so as to allow them to flex during play in a manner corresponding to a wearer's hand, finger or thumb without significantly impacting the protection provided thereto.

One issue with gloves of this type is the degree of protection from impact provided to the wearer during usage. Foam padding or other protective structures on the outer portions of the gloves generally provide an adequate amount of relief from impact due to a stick, ball or puck. The amount of protection depends primarily upon the thickness and composition of the padding as well as the angle of impact of the device contacting the glove. In order to provide flexibility to the wearer's fingers, gloves are typically provided with flex or break lines between adjacent pads that are located over the respective knuckles of the fingers and thumb to accommodate increased movement of the wearer's fingers and thumb. Flex or break lines are also provided in the back of the hand for increased flexibility such that a glove is allowed to accommodate movement of a wearer's hand.

While these gloves have increased protection, it is known that to provide desired flexibility, flex or break lines are provided in the glove. Thus, when a wearer flexes his fingers or thumb around the stick or otherwise flexes their hand, a gap is created between the adjacent pads in the area of the knuckles and exposes the knuckle making it particularly vulnerable to impact from a stick, ball or puck. Such impact can result in a serious injury to a wearer's fingers or thumb. Thus, there exists a need for a protective sports glove that provides protection to the knuckles or other exposed areas of a player's hand during usage, regardless of the amount of flex of the fingers or thumbs, yet does not affect the degree of flex of the fingers or thumb during that same usage.

SUMMARY OF THE INVENTION

Accordingly, it is an advantage of the present invention to provide a protective sports glove that yields increased protection to the knuckles of the fingers and/or the thumb of a wearer without adversely affecting the degree of flex or movement of the wearer's fingers and thumbs during play.

It is another advantage of the present invention to provide a protective knuckle system for a protective sports glove that covers any gap or space created between adjacent protective portions when a glove is flexed by a wearer during play and protects any exposed area of a wearer's hand.

In accordance with the above and the other advantages of the present invention, a protective knuckle system for a protective sports glove is provided. The glove includes a protective knuckle system disposed on the outside or back portion of the glove generally in the finger and/or thumb portions. The protective knuckling system includes a flexible base section that is sewn or otherwise affixed to an underlying inner layer. The flexible base section is generally located between adjacent protective portions on the finger portion or thumb portion of the glove at a flex or break line and generally overlies a wearer's knuckles. The flexible base section includes at least one protruding portion extending upwardly and outwardly from the flexible base section opposite the inner layer. The protective knuckle system also includes a cap portion coupled within or to the ends of each of the respective protruding portions. The cap portions are made of an impact resistant material, such as plastic or metal that protects a wearer's knuckle.

The knuckle cap portions are disposed between adjacent padded portions and span the gaps between the protective portions of the fingers and the thumb and thus provide protection to the knuckles of the wearer when the fingers or thumb are flexed. The knuckle cap portions are in a retracted or compressed position in the space between adjacent protective portions when the finger or thumb is in an unflexed position. When the finger or thumb portion is flexed, the knuckle cap portions move apart or separate from one another to an extended position to fill up the space between the adjacent protective portions. By spreading out, the protrusions leave only small spaces therebetween. The knuckle protection system thus allow the finger and/or thumb to flex and unflex freely without restriction and without compromising protection and provides protection at the open space between pads that overlies the knuckle throughout the full range of wearer movement.

These and other features and advantages of the present invention will become apparent from the following description of the invention, when viewed in accordance with the accompanying drawings and appended claims.

DETAILED DESCRIPTION OF THE PREFERRED EMBODIMENT

Referring now to the Figures, which illustrate a protective sports glove 10 in accordance with the present invention. While the drawings illustrate the right hand glove, it will be understood that the left hand glove has the same configuration, but opposite orientation and thus need not be described separately. The disclosed glove 10 is preferably for use in the game of lacrosse. However, it will be understood by one of ordinary skill in the art that the disclosed glove 10 may be used in a variety of other contact stick sports, including hockey. Additionally, the protective sports glove may have a variety of other suitable uses.

Figure 1:
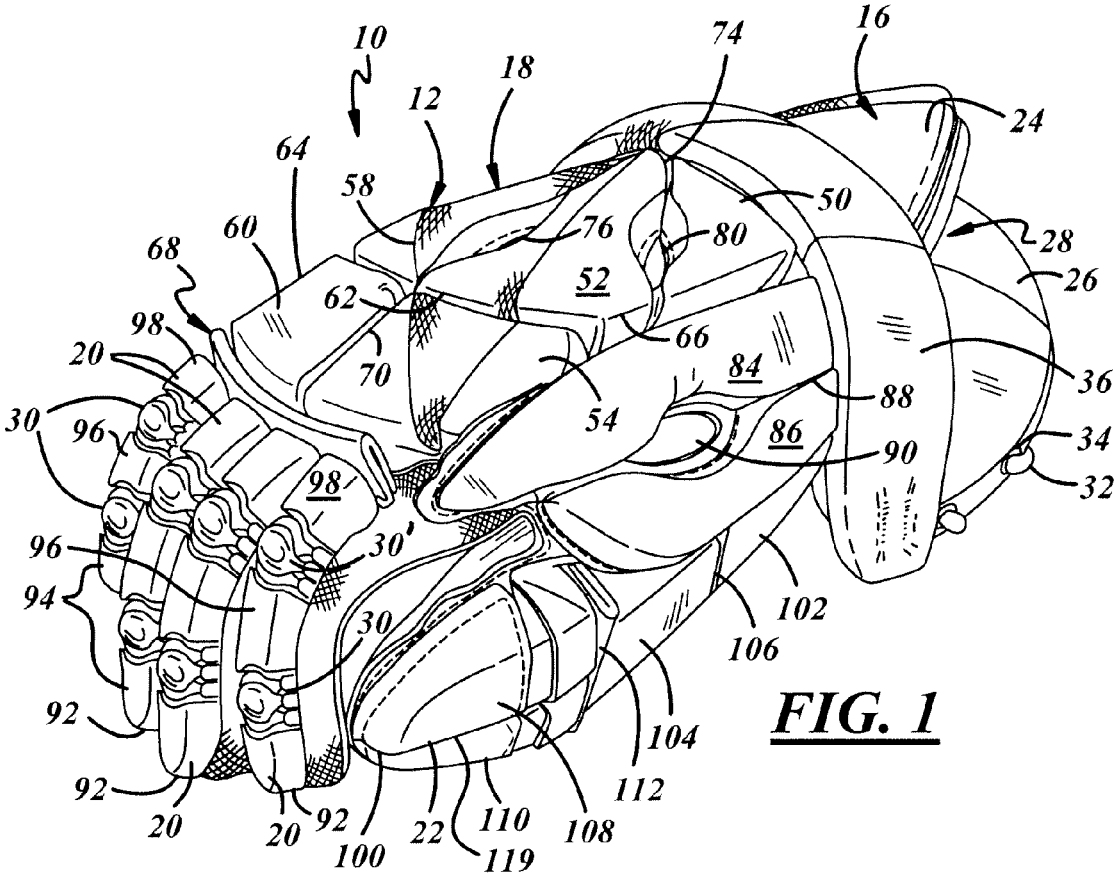
FIG. 1 is a perspective view of a protective sports glove with a protective knuckle system in an unflexed or compressed position in accordance with a preferred embodiment of the present invention.
Figure 2:
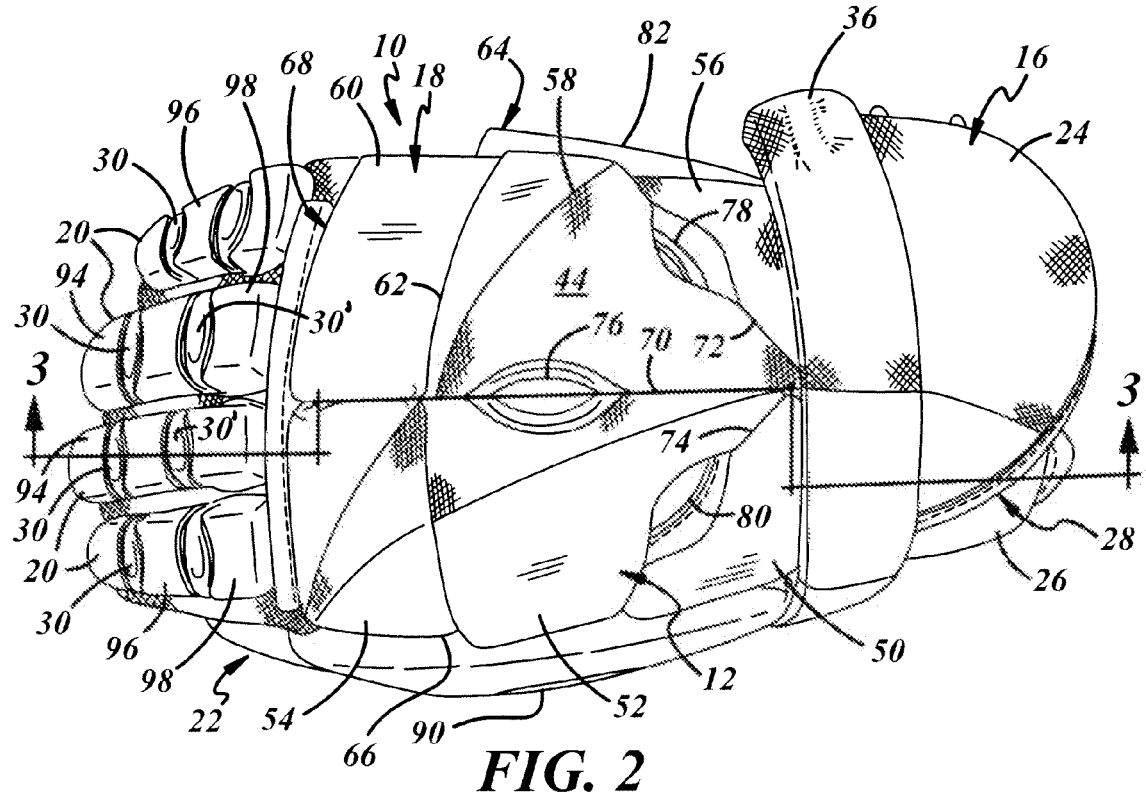
FIG. 2 is a top view of the protective sports glove of FIG. 1.
Figure 3:
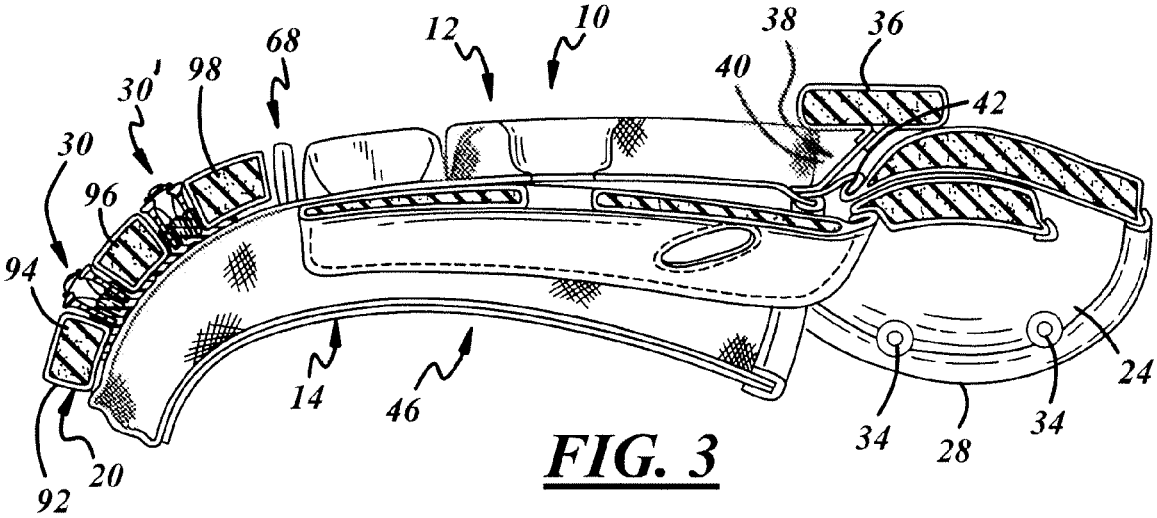
FIG. 3 is a cross-sectional view of the protective sports glove of FIG. 2 in the direction of the arrows 3-3.

Referring now to FIGS. 1 through 3, the glove 10 has a top (backside) portion 12 and a bottom (palmside) portion 14 which therebetween define an interior space for receipt of a wearer's hand. The glove 10 generally has a cuff portion 16, a hand portion 18 coupled to the cuff portion 16, a plurality of finger portions 20 extending from the hand portion 18, and a thumb portion 22 also extending from the hand portion 18. In one embodiment, the cuff portion 16 can include a floating subcuff portion 33 disposed within and coupled to the cuff portion 16. Each of the finger portions 20 includes at least one protective knuckle system 30, 30' as discussed in more detail below.

The cuff portion 12 preferably has a first cuff portion 24 and an adjacent second cuff portion 26. The first cuff portion 24 and the second cuff portion 26 are secured at an upper border portion located near the hand portion 18. The first cuff portion 24 and the second cuff portion 26 each have an edge that preferably overlaps the opposing edge of the other cuff portion to provide both maximum flexibility and protection. Specifically, the overlapping edge portions of the cuff portions yields a split cuff, as generally indicated by reference number 28. The first cuff portion 24 and the second cuff portion 26 are designed to cover and protect substantial portions of a wearer's wrist and forearm. The overlapping (split cuff) configuration of the cuff portions 24, 26 provides added protection to a wearer's wrist and forearm because of the double layer of padding. Additionally, since the cuff portions 24, 26 can move with respect to one another, they provide increased flexibility for a wearer's wrist as it moves during play. For example, the overlapping configuration of the cuff portions 24, 26 allow the cuff portions to move as a wearer's hand flexes and not open any undesirable gaps that would expose a wearer to injury. As will also be understood by one of ordinary skill in the art, a split cuff portion without overlapping portions or edges, but instead are simply aligned edge to edge, may also be employed. Further, the cuff portion 12 can consist of more than two cuff portions or can consist of a single structure or multiple structures secured together.

As shown, in one embodiment, the first cuff portion 24 and the second cuff portion 26 do not extend entirely around the wearer's wrist and are connected by a lace that passes through openings 34 in each of the cuff portions. Alternatively, the cuff portion 16 can consist of either a single or multiple pieces that extend entirely around a wearer's wrist, as will be readily understood by one of ordinary skill in the art. Other securing mechanism besides a lace may also be employed.

Additionally, a wrist guard 36 is preferably coupled to the glove 10 such that it covers the space 38 between the bottom edge 40 of the hand portion 18 and the upper edge 42 of the cuff portion 12 as a wearer's hand moves and flexes during play to provide increased protection. The wrist guard 36 can be attached to the hand portion 18 or the cuff portion 16 or both and can be secured thereto by a variety of other suitable ways. Alternatively, the wrist guard 36 may be disposed within the interior space of the glove 10 to cover the space 38 from below the top portion 12.

The hand portion 18 extends generally between the space or gap 38 and the finger portions 20 and has a rear portion 44 and a palm portion 46. The rear portion 44 preferably has a plurality of protective portions, such as padded portions, secured thereto to provide protection to a wearer's hand. However, protective portions constructed of other suitable material, such as plastic or rubber, may also be utilized. As shown, the rear portion 44 is preferably subdivided into a plurality of protective portions 50, 52, 54, 56, 58, 60 that are sewn to an outer liner or material. The rear portion 44 of the glove 10 has a first lengthwise flex or break line 62, i.e., from one side 64 of the hand portion 18 to the other side 66 of the hand portion 18, which allows the hand portion 18 to bend along the first lengthwise flex or break line 62 as a wearer's hand moves. The first lengthwise flex line 62 allows the glove 10 to move as a wearer's hand moves to provide better fit and comfort.

The protective portions 54, 60 terminate at a junction 68 located generally between the hand portion 18 and the finger portions 20. The junction 68 allows the finger portions 20 to move and flex with respect to the protective portions 54 and 60 as the junction 68 is generally disposed over a wearer's knuckle area, allowing the finger portions 20 to move as a wearer's fingers flex. Additionally, the rear portion 44 has a vertical flex or break line 70 that extends generally from the cuff portion 16 to the junction 68 and allows protective portions on either side thereof to move respect to one another. The vertical flex or break line 70 allows the glove to fit more comfortably as it allows the glove to better conform to a wearer's hand as he closes his hand around a stick and, therefore, provide a tighter shape. This is desirable as the back of a typical wearer's hand is not flat, and the protective portions are not flexible enough to bend without the vertical flex or break line 70.

The rear portion 40 of the hand portion 18 also preferably has a pair of opposing angled flex lines 72 and 74 which begin generally at the base of the hand portion 18 adjacent the space 38 and extend generally outward to a respective side 64, 66 of the hand portion 18. The angled flex lines 72, 74 similarly assist the glove 10 in conforming to the wearer's hand as the protective portions 50, 56 can each independently move with respect to the other protective portions as a wearer's hand flexes during play, thus providing a better fitting glove with increased flexibility. The rear portion 44 may have a variety of additional or different flex lines as desired.

In a preferred embodiment, the rear portion 44 of the hand portion 18 has a plurality of vent openings formed therein to provide ventilation to a wearer's hand. A vent opening 76 is preferably disposed along the vertical flex line 70. A vent opening 78 is preferably disposed along the first angled flex line 72. Another vent opening 80 is preferably disposed along the second angled flex line 74. The vent openings provide ventilation to a wearer's hand by allowing air into the glove interior. It should be understood that while three vent openings are disclosed on the rear portion 44 of the glove 10, any number of vent openings may be utilized. Additionally, the vent openings may be disposed in a variety of other locations along the rear portion 44 in accordance with the preferred embodiment, including within or through the respective individual protective portions themselves, instead of along the flex lines.

The first side 64 of the glove preferably has a mesh layer extending between the rear portion 44 and the palm portion 46 of the glove 10 with a protective portion 82 secured thereon. The second side 66 of the glove 10 also has a protective portion that is sub-divided into an upper portion 84 and a lower portion 86 by a vertical flex line 88 formed therein. A side vent opening 90 is preferably formed along the vertical flex line 88.

Referring now to the plurality of finger portions 20, which extend generally from the junction 68 to a respective tip 92. The finger portions 20 each include a plurality of protective portions 94, 96, 98. Each of the plurality of protective portions 94, 96, 98 on one or more of the finger portions 20 is separated by a gap, space, or break in the protective portions. In accordance with a preferred embodiment, a protective knuckle system 30, as will be described in further detail below in connection with FIGS. 4 through 7, is disposed in each gap. It will be understood that more or less, protective portions may be included or utilized on each finger portion 20.

The thumb portion 22 has a plurality of protective portions formed thereon that extend to its tip portion 100. The thumb portion 22 has a first protective portion 102 disposed adjacent a second protective portion 104, which are separated by a horizontal flex line 106. The second protective portion 104 is disposed adjacent a third protective portion, which is sub-divided into a first part 108 and a second part 110 by a vertical flex line 112. A second horizontal flex line 114 is disposed between the second protective portion 104 and the first and second parts of the third protective portion 108, 110. An alternative arrangement of the thumb portion 22 is described below in connection with FIG. 8. It will be understood that the protective portions or flex lines on the thumb portion 22 can take on a variety of different configurations.

Referring now to FIGS. 4 through 7, the finger portions 20 each preferably have a protective knuckle system 30 disposed between adjacent protective portions located on each finger portion 20. Specifically, a first protective knuckle system 30 is located between the protective portions 94 and 96. A second protective knuckle system 30' is located between the protective portions 96 and 98.

Each protective knuckle system 30, 30' includes a flexible base section 120. The flexible base section 120 is preferably formed from a soft plastic material. However, a variety of other suitable materials may be utilized which allow the base section to flex or bend. The flexible base section 120 includes a bottom surface 122 that engages an underlying inner layer 124 of the glove 10. The bottom surface 122 is preferably sewn or otherwise affixed to the underlying inner layer 124. It will be understood that the flexible hinge section 120 may alternatively be secured to the glove 10 in other ways including by securing it to each of the adjacent protective portions. Alternatively, the flexible base section 120 can be sandwiched in place. Additionally, in one embodiment, the bottom surface 122 includes a pair of flange portions 126 which are sandwiched between the underside of the protective portions (i.e. 92, 94) and the underlying inner layer 124 to assist in securing the protective knuckle system 30 to the glove 10.

The flexible base section 120 includes a plurality of protruding portions 128 that extend upwardly and outwardly from the flexible base section 120. In other words, the protruding portions 128 extend away from the underlying inner layer 124. In one preferred embodiment, as shown in FIGS. 4 through 7, the flexible base section 120 includes three upwardly protruding portions 128. However, it will be understood that more or less protruding portions 128 may be utilized and still fall within the spirit of the present invention.

Each of the respective protruding portions 128 has an end portion 130 to which a knuckle cap portion 132 is coupled or attached. In one embodiment, the knuckle cap portions 132 are made of an impact resistant material that protects a wearer's knuckle. In the case of a lacrosse glove, the knuckle cap portions 132 provide impact protection against, for example, a swinging lacrosse stick or a lacrosse ball. For a hockey glove, the knuckle cap portions 132 provide impact protection against, for example, a swinging hockey stick or hockey puck. Impact resistant materials that may be used in the knuckle cap include, but are not limited to, hard plastic materials, rubber, or metal that are molded or otherwise formed to the desired shape. Preferably, the knuckle cap portions 132 are secured within the end portions 130 of the protruding portions 128, such as by an insertion or press fit attachment.

The knuckle cap portions 132 are generally oval in shape. Specifically, the top portion 140 is wider in the middle portions and narrower at each end. Further, as discussed in more detail below, the knuckle cap portion 132 of the middle portion is larger than the knuckle cap portions 132 of either adjacent side portion. This provides increased protection over any exposed area of a wearer's fingers resulting from a space between adjacent pads when a player flexes his fingers during play. Moreover, the middle portion is raised higher than the adjacent side portions to allow for telescopic movement. While the knuckle cap portions are generally oval, a variety of other shapes may be utilized.

Figure 6:
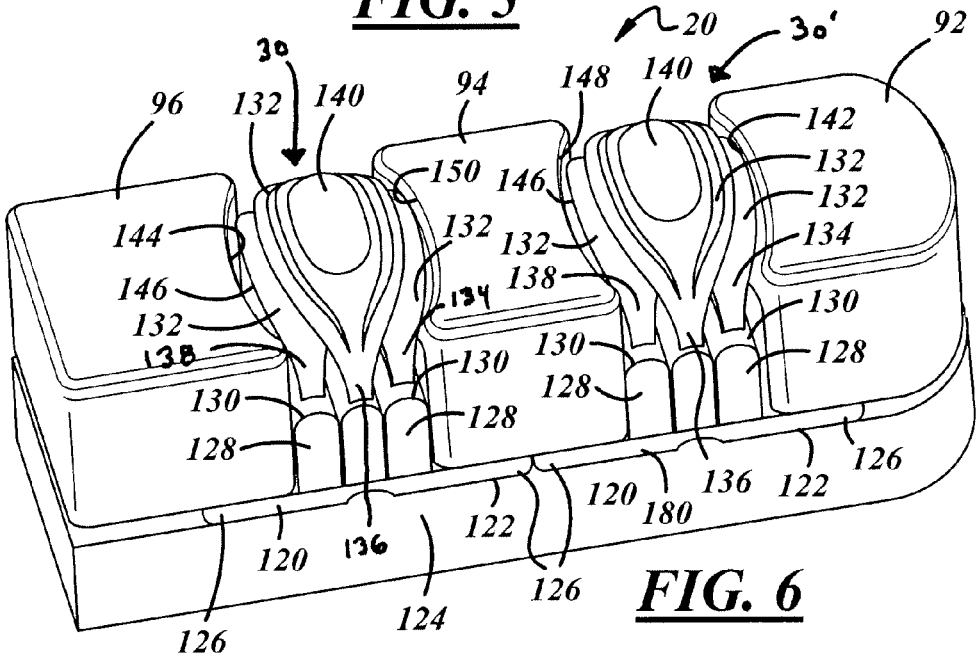
FIG. 6 is a schematic illustration of a finger portion for a protective sports glove having a protective knuckle system in an unflexed or compressed position in accordance with a preferred embodiment of the present invention.
Figure 7:
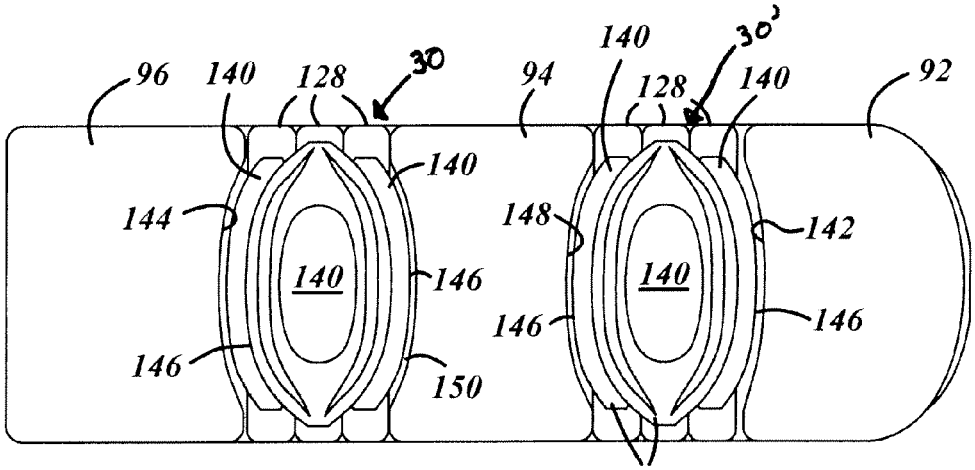
FIG. 7 is a schematic illustration from the top of a finger portion for a protective sports glove with a protective knuckle system in an unflexed or compressed position in accordance with a preferred embodiment of the present invention.

Referring now to FIGS. 6 and 7, which illustrate one finger portion 20 utilizing the protective knuckle system 30 in an unflexed ("closed") position. In the unflexed or compressed position, the finger is generally straight and the protruding portions 128 are extending generally upward and perpendicular to the underlying inner layer 124. Additionally, the protruding portions 128 are aligned such that there is either no gap or minimal gap therebetween when viewed from the top and the side. In this position, the sides 134 of the knuckle cap portions 132 are generally aligned with a respective side 136 of an adjacent knuckle cap portion 132. In addition, the sides 138 of the knuckle cap outermost portion 132 are generally aligned with an adjacent side of the protective portion 96. Similarly, the sides 134 of the knuckle cap portions 132 are generally aligned with an adjacent side of the protective portion 94. It will be appreciated that the alignment and configuration of the protruding portions can be varied as desired.

Similarly, the protective knuckle system 30' is also illustrated in an unflexed or compressed position. As shown in this position, the protruding portions 128 are generally aligned such that there is either no gap or minimal gap therebetween.

In this position, the sides 134 of the knuckle cap portions 130 are generally aligned with a respective side 136 of an adjacent knuckle cap portion 132. In addition, the sides 138 of the knuckle cap portion 132 are generally aligned with an adjacent side of the protective portion 94. Also, the sides 134 of the knuckle cap portion 132 are generally aligned with an adjacent side of the protective portion 92.

The knuckle systems 30, 30' are in the compressed or unflexed position when the finger is in a generally straight position. It will also be understood that the knuckle system 30, 30' are preferably in a compressed position when the finger portion is slightly curved, as shown in FIGS. 1 and 2. Further, FIGS. 6 and 7 only illustrate the knuckle systems 30, 30' for a single finger, it will be understood that the description applies to all fingers.

As best shown in FIG. 7, the tops 140 of each of the knuckle cap portions 132 are aligned in a substantially telescopic fashion such that the two outermost knuckle cap portions 132 are underlying the middle knuckle cap portion 132 in the unflexed position. Alternatively, the middle knuckle cap portion 132 can slide under the sides of the outermost knuckle cap portions 132. Further, the caps 140 of the knuckle cap portions 132 can align side by side. It will be understood that the knuckle cap portions are preferably of different heights with the outermost portions being smaller than the middle portion. Additionally, the protective portions 92 and 96 each have an inner edge 142, 144, respectively, that is generally concave in shape in order to match the outer edge 146 of each of the outermost knuckle cap portions 132. Both edges 148, 150 of the protective portion 94 are generally concave in shape to match the outer edges 146 of the adjacent outermost knuckle cap portions 132. In the unflexed position, the knuckle cap portions 132 and the protective knuckle systems 30, 30' protect a wearer's knuckle and/or finger from impact without affecting the flexibility or degree of flex of the finger portion 20. Obviously, the protruding portions 128 and the knuckle cap portions 132 can take on various configurations, so long as they provide protection to the wearer's knuckle.

Figure 4:
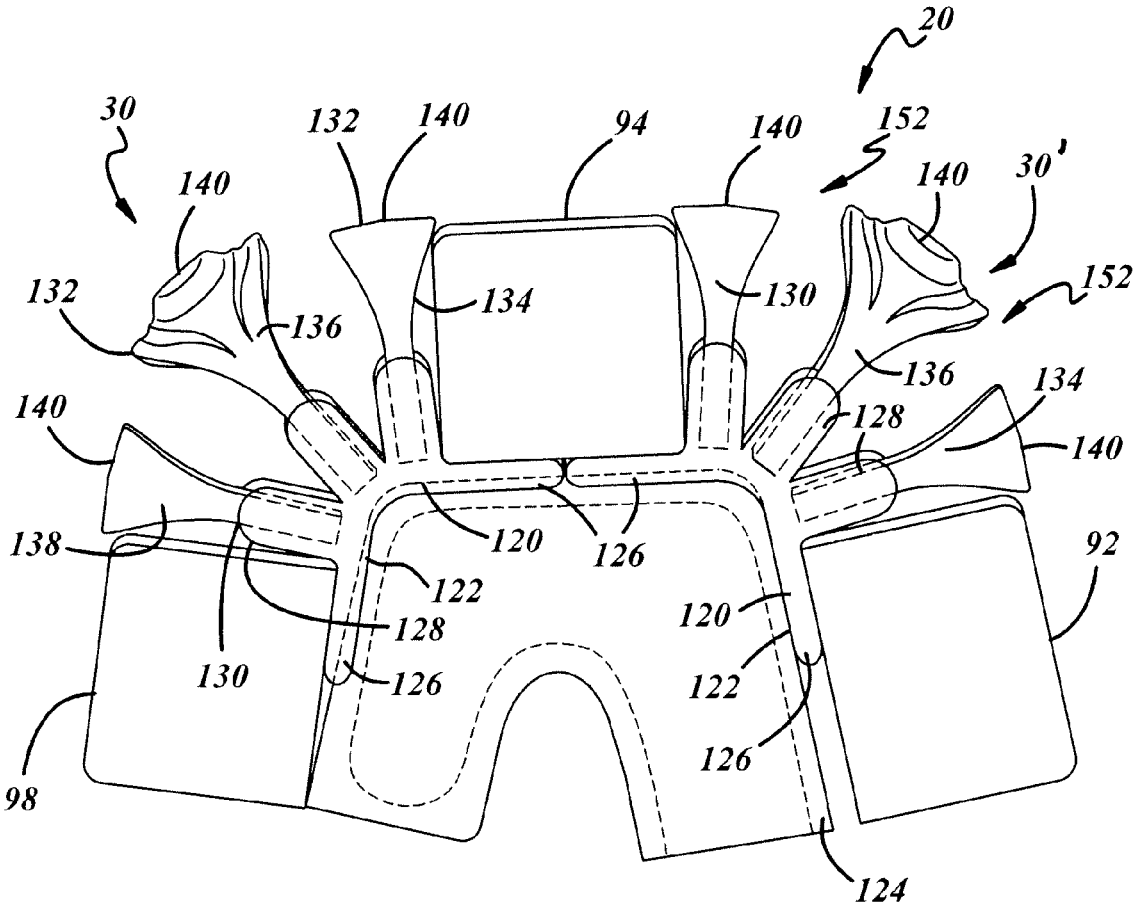
FIG. 4 is a schematic illustration from the side of a finger portion for a protective sports glove with a protective knuckle system in a flexed or extended position in accordance with a preferred embodiment of the present invention.
Figure 5:
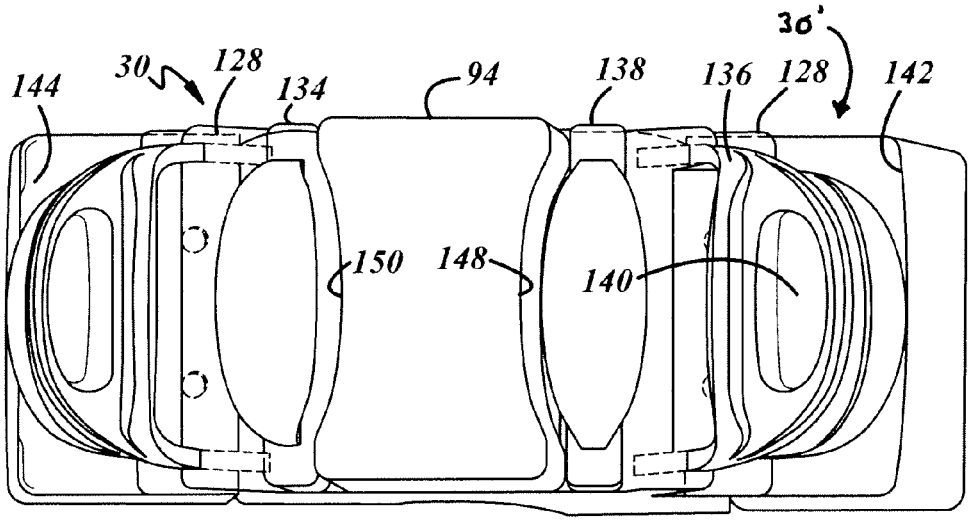
FIG. 5 is a schematic illustration from the top of a finger portion for a protective sports glove with a protective knuckle system in a flexed position in accordance with a preferred embodiment of the present invention.

In the flexed position, as shown in FIGS. 4 and 5, the flexible base section 120 flexes in relation to the flexing finger, therein separating the respective protruding portions 128 and thus the knuckle cap portions 132 from each other and from the respective padded portions 92, 94, 96 as the finger flexes. However, the spacing between the tops 140 of the knuckle cap portions 132 is insufficient to allow a stick, ball or puck to infiltrate within the protective knuckle system 30, 30' or between the protective knuckle system 30, 30' and an adjacent protective portion. This provides the wearer maximum protection to the underlying finger and knuckle while allowing maximum flexion of the finger during use. Further, the more the wearer flexes their finger, the larger the space 152 between the knuckle cap portions 132. Additionally, the less the wearer flexes their finger, the smaller the space between the knuckle cap portions 132. Even with the largest flex, the tops 140 of the knuckle cap portion 132 are spaced close enough together to provide protection for the knuckle of a wearer. Additionally, one or more of the tops 140 of the knuckle cap portions 132 have a raised portion 180 to provide additional material thickness and thus increased protection.

Figure 8:
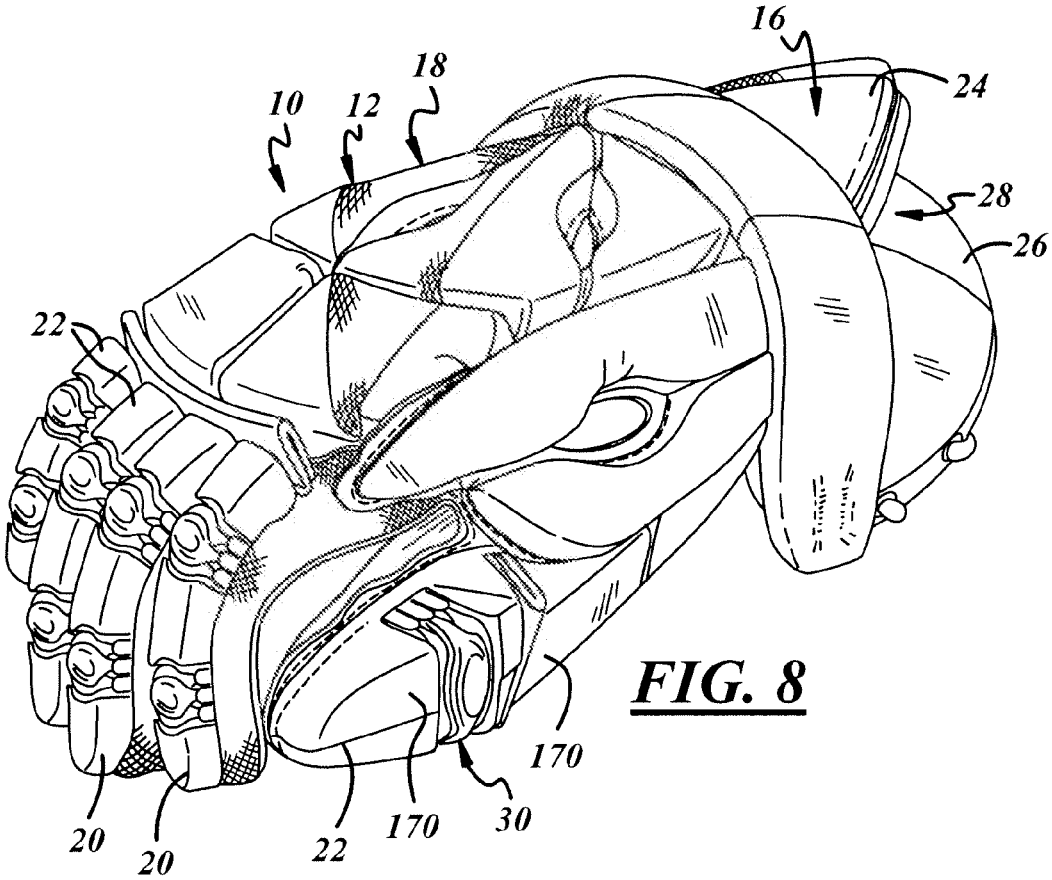
FIG. 8 is a perspective view of a protective glove with a protective knuckle system in an unflexed position in accordance with another preferred embodiment of the present invention.
Figure 9:
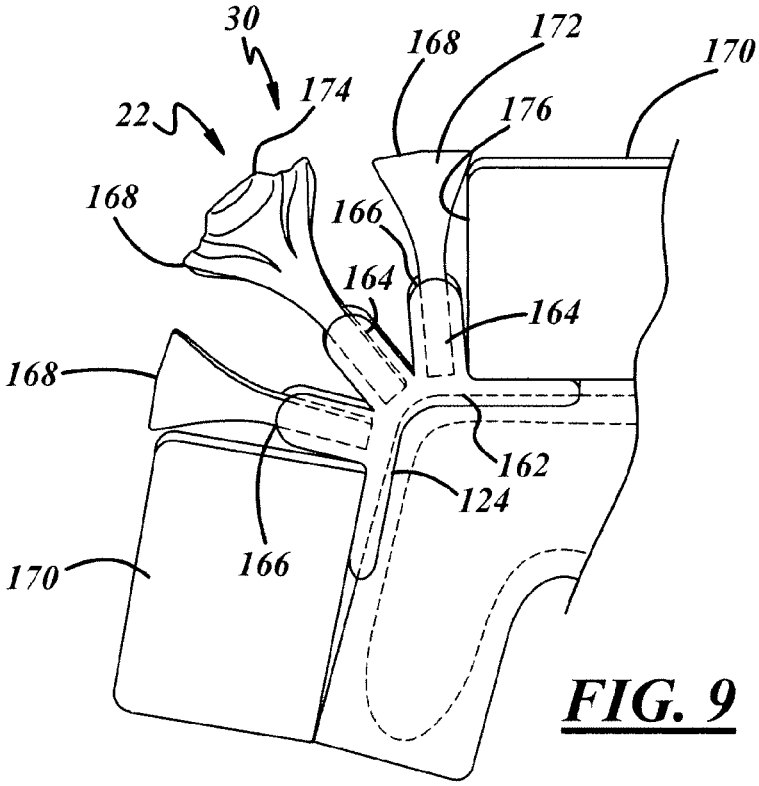
FIG. 9 is a schematic illustration of a thumb portion for a protective sports glove having a protective knuckle system in a flexed position in accordance with a preferred embodiment of the present invention.

In another alternative embodiment, as shown in FIGS. 8 and 9, the thumb portion 22 includes a protective knuckle system 160. The protective knuckle system 160 is substantially similar in construction to the protective knuckle system 30 described above for protecting the wearer's fingers. The protective knuckle system 160 includes a flexible base section 162 that is sewn or otherwise affixed to the underlying inner layer 124 in the same manner discussed above. The flexible base section 160 includes a plurality of protruding portions 164 extending upwardly and outwardly from the flexible base section 160 opposite the underlying inner layer 124. In one preferred embodiment, as shown in FIG. 9, three protruding portions 164 are depicted. However, more or less protruding portions 164 may be utilized as desired.

Coupled within or to the end portions 166 of each of the respective protruding portions 164 is a knuckle cap portion 168. The knuckle cap portions 168 are made of an impact resistant material that protects a wearer's thumb knuckle. In the case of a lacrosse glove, the knuckle cap portions 168 provide impact protection for the thumb against a swinging lacrosse stick or lacrosse ball. For a hockey glove, the knuckle cap portions 168 provide impact protection for the thumb against a swinging hockey stick or hockey puck. Impact resistant materials that may be used in the knuckle cap portion 168 include, but are not limited to, hard plastic materials or metal that are molded or otherwise formed to the desired shape. Preferably, the knuckle cap portions 168 are secured within the ends 166 of the protruding portions 164 in the same manner discussed above.

Similar to the protective knuckle system 30, the flexible base section 160 flexes in relation to the flexing thumb, therein separating the respective knuckle cap portions 168 from each other and from the respective adjacent protective portions 170. However, the spacing apart of the tops 172, 174 of the knuckle cap portions 168 and adjacent portion 176 of protective portion 170 is insufficient to allow a stick or ball to infiltrate between the respective knuckle cap portions 168 or between a knuckle cap portion 168 and the adjacent protective portion 170 therein providing the wearer maximum protection to the underlying thumb and knuckle while allowing maximum flexion of the thumb during use.

It will also be understood that while a protective knuckle system has been shown and described for use in protecting the knuckle of a wearer, the protective system could also be utilized between adjacent protective potions on the rear portion 44 of the glove.

While particular embodiments of the invention have been shown and described, numerous variations or alternate embodiments will occur to those skilled in the art. Accordingly, it is intended that the invention be limited only in terms of the appended claims.

What is claimed is:

1. A protective sports glove, comprising:

a hand portion comprising a palm portion and an opposing backside portion;

a plurality of finger portions secured to and extending from said hand portion for receipt of a wearer's fingers therein, each of said plurality of finger portions including a finger palm portion and an opposing padded finger portion, said opposing padded finger portion comprising a plurality of finger protective portions each separated by a gap, said gap corresponding to a knuckle of a wearer when the wearer's hand is disposed in an interior of the glove;

a thumb portion secured to and extending from said hand portion for receipt of a wearer's thumb therein, said thumb portions including a thumb palm portion and an opposing padded thumb portion;

a protective knuckle system coupled to at least one of said plurality of finger portions and coupled to said gap between an adjacent pair of said finger protective portions, said protective knuckle system including a plurality of upwardly protruding portions coupled to and extending from a flexible base section at least partially disposed beneath an outer surface of said plurality of finger protective portions; and a knuckle cap portion attached to an end of at least one of said protruding portions.

2. The protective sports glove of claim 1, wherein two of said protruding portions extend from said flexible base section along opposite sides of said protective portions.

3. The protective sports glove of claim 1, wherein said knuckle cap portion extends forwardly and rearwardly beyond said at least one protruding portion.

4. The protective sports glove of claim 1, wherein said knuckle cap portion is formed from an impact resistant material.

5. The protective sports glove of claim 4, wherein said impact resistant material comprises at least one of metal, rubber and plastic.

6. The protective sports glove of claim 2, wherein said flexible base is adapted to extend beneath said protective portions from one gap to an adjacent gap on said finger portion, wherein said protruding portions at each of said gaps extend from said flexible base.

7. The protective sports glove of claim 1, wherein said plurality of protruding portions of one of said protective knuckle systems comprises a middle protruding portion coupled between a first outer protruding portion and a second outer protruding portion, wherein said knuckle cap portion of said first outer protruding portion and said second outer protruding portion are underlying said knuckle cap portion of said middle protruding portion when the protective sports glove is in an unflexed position.

8. The protective sports glove of claim 7, wherein each respective side of said middle protruding portion is aligned with a corresponding side of each of said first protruding portion and said second protruding portion when the protective sports glove is in said unflexed position; and wherein each respective side of said first protruding portion is aligned with a corresponding side of one of said adjacent pair of said finger protection portions and wherein each respective side of said second protruding portion is aligned with a corresponding side of the other of said adjacent pair of said finger protection portions when the protective sports glove is in said unflexed position.

9. The protective sports glove of claim 1, wherein said plurality of protruding portions of one of said protective knuckle systems comprises a middle protruding portion coupled between a first outer protruding portion and a second outer protruding portion, wherein said knuckle cap portion of said first outer protruding portion and said second outer protruding portion are overlying said knuckle cap portion of said middle protruding portion when the protective sports glove is in an unflexed position.

10. The protective sports glove of claim 9, wherein each respective side of said middle protruding portion is aligned with a corresponding side of each of said first protruding portion and said second protruding portion when the protective sports glove is in said unflexed position; and wherein each respective side of said first protruding portion is aligned with a corresponding side of one of said adjacent pair of said finger protection portions and wherein each respective side of said second protruding portion is aligned with a corresponding side of the other of said adjacent pair of said finger protection portions when the protective sports glove is in said unflexed position.

11. The protective sports glove of claim 1, wherein said knuckle cap portion on one of said protruding portions telescopingly overlaps another of the protruding portions when the finger portion is in an unflexed position, said knuckle cap portion and said plurality of protruding portions cooperating to at least partially cover the gap when the finger portion is in a flexed position.

12. The protective sports glove of claim 1, wherein said plurality of protruding portions of one of said protective knuckle systems comprises a middle protruding portion coupled between a first outer protruding portion and a second outer protruding portion, wherein said knuckle cap portion of said first outer protruding portion and said second outer protruding portion are adjacent to and aligned with said knuckle cap portion of said middle protruding portion when the protective sports glove is in an unflexed position.

13. The protective sports glove of claim 12, wherein each respective side of said middle protruding portion is aligned with a corresponding side of each of said first protruding portion and said second protruding portion when the protective sports glove is in said unflexed position; and wherein each respective side of said first protruding portion is aligned with a corresponding side of one of said adjacent pair of said finger protection portions and wherein each respective side of said second protruding portion is aligned with a corresponding side of the other of said adjacent pair of said finger protection portions when the protective sports glove is in said unflexed position.

14. The protective sports glove of claim 1, wherein a bottom portion of said flexible base section is engaged with an underlying inner layer of the protective sports glove.

15. The protective sports glove of claim 1, wherein a bottom portion of said flexible base section is affixed to an underlying inner layer of the protective sports glove.

16. The protective sports glove of claim 1, wherein a bottom section of said flexible base section includes a pair of flange portions, one said flange portion coupled between an underlying inner layer of the protective sports glove and an underside of one of said plurality of finger protective portions and the other of said pair of flange portions coupled between said underlying inner layer of the protective sports glove and an underside of an adjacent one of said plurality of finger protective portions.

17. The protective sports glove of claim 1 further comprising a thumb protective knuckle system coupled to said thumb portion and disposed over a gap between an adjacent pair of said thumb protective portions defining said opposing thumb padded portion, said thumb protective knuckle system including a plurality of protruding portions coupled to and extending from a flexible base section, each of said protruding portions including an end portion to which a knuckle cap portion is coupled.

18. A protective sports glove, comprising:

a hand portion comprising an inner palm portion and an opposing backside portion;

a plurality of digit portions secured to and extending from said hand portion for receipt of a wearer's digits therein, each of said plurality of digit portions including a digit palm portion and an opposing padded digit portion, said opposing padded digit portion including a plurality of digit protective portions each separated by a gap, said gap corresponding to a knuckle of a wearer;

a protective knuckle system coupled to at least one of said plurality of digit portions, said protective knuckle system including a plurality of protruding portions extending from a flexible base that extends generally along at least one of said plurality of digit portions, wherein said protruding portions extend from said base at opposite sides of each of the digit portions; and wherein a knuckle cap portion is joined with said protruding portions at least one of said gaps, said knuckle cap portions adapted to substantially cover said gap when a wearer flexes said digit portion.

19. The protective sports glove of claim 18, wherein said protruding portions extend along the length of said digit portion at opposite sides of said protective portions.

20. A protective sports glove, comprising:

a hand portion comprising an inner palm portion and an opposing backside portion;

a plurality of digit portions secured to and extending from said hand portion for receipt of a wearer's digits therein, each of said plurality of digit portions including a digit palm portion and an opposing padded digit portion, said opposing padded digit portion comprising a plurality of digit protective portions each separated by a gap, said gap corresponding to a knuckle of a wearer; and a protective knuckle system coupled to at least one of said plurality of digit portions, said protective knuckle system including a plurality of protruding portions, wherein at least one of said protruding portions is joined with a knuckle cap portion;

wherein at least one of said knuckle cap portions and said protruding portions cover a gap between an adjacent pair of said digit protective portions created when said digit portion is in a flexed position and wherein said knuckle cap portion of one of said plurality of protruding portions aligns with an adjacent knuckle cap portion of an adjacent one of said plurality of protruding portions when said digit portion is in an unflexed position.

21. The protective sports glove of claim 20, wherein said protruding portions extend from a flexible base, wherein at least a portion of said flexible base is positioned below said protective portions.

22. A protective sports glove comprising:

a hand portion including an inner palm portion and an opposing back side portion;

a digit portion joined with the hand portion for receipt of a wearer's digit therein, the digit portion including a digit palm portion and an opposing digit portion having first and second protective portions defining a gap therebetween, the gap corresponding to a knuckle of a wearer's hand;

a protective knuckle system joined with the digit portion, the protective knuckle system including a base joined with the digit portion and adapted to flex when the digit is in a flexed position, the protective knuckle system including a plurality of members that protrude from the base, at least one of the members including a cap that telescopingly overlaps another of the members when the digit is in an unflexed position, the cap and plurality of members cooperating to at least partially cover the gap when the digit is in a flexed position.

* * * * *